US011536463B2

(12) United States Patent
Duffy et al.

(10) Patent No.: US 11,536,463 B2
(45) Date of Patent: Dec. 27, 2022

(54) COOKTOP WITH SIDE FRAME MEMBERS

(71) Applicant: WHIRLPOOL CORPORATION, Benton Harbor, MI (US)

(72) Inventors: Patrick J. Duffy, St. Joseph, MI (US); Thomas Walker Faussett, St. Joseph, MI (US); Paul Jordan Neuman, St. Joseph, MI (US); Binesh R. Pillai, Navi Mumbai (IN); Edward Benjamin Standen, St. Joseph, MI (US); Nicholas Edward Righetti, Detroit, MI (US); Sarah Katherine Small, St. Louis, MO (US)

(73) Assignee: Whirlpool Corporation, Benton Harbor, MI (US)

( * ) Notice: Subject to any disclaimer, the term of this patent is extended or adjusted under 35 U.S.C. 154(b) by 241 days.

(21) Appl. No.: 16/556,908

(22) Filed: Aug. 30, 2019

(65) Prior Publication Data

US 2021/0063020 A1 Mar. 4, 2021

(51) Int. Cl.

| | |
|---|---|
| ***F24C 15/10*** | (2006.01) |
| ***F24C 3/08*** | (2006.01) |
| ***F24C 15/08*** | (2006.01) |

(52) U.S. Cl.

CPC ..... *F24C 15/10* (2013.01); *F24C 3/085* (2013.01); *F24C 15/08* (2013.01); *F24C 15/101* (2013.01)

(58) Field of Classification Search

CPC ..... F24C 15/006; F24C 15/08; F24C 15/10; F24C 15/101; F24C 15/2014; F24C 3/085; F24B 5/025; F24B 5/026; F24B 5/06

USPC ..... 126/211

See application file for complete search history.

(56) References Cited

U.S. PATENT DOCUMENTS

| | | | | |
|---|---|---|---|---|
| 2,358,527 | A * | 9/1944 | Moecker, Jr. | F24C 15/10 126/39 H |
| 3,645,249 | A * | 2/1972 | Henderson | F24C 15/10 126/39 H |
| 3,859,499 | A * | 1/1975 | Evans | F24C 14/02 219/396 |

(Continued)

FOREIGN PATENT DOCUMENTS

| | | |
|---|---|---|
| DE | 102014209955 A1 | 11/2015 |
| EP | 3217098 A1 | 9/2017 |

(Continued)

OTHER PUBLICATIONS

Hwang, Machine Translation (Year: 2003).*

(Continued)

*Primary Examiner* — Jorge A Pereiro
*Assistant Examiner* — Logan P Jones
(74) *Attorney, Agent, or Firm* — Price Heneveld LLP

(57) ABSTRACT

A cooking appliance includes a body and a cooktop disposed on the body. A plurality of gas burner assemblies is operably coupled to the cooktop. A first frame member is coupled to a first side of the cooktop and defines at least a portion of a sump defined by the cooktop. A second frame member is coupled to a second side of the cooktop and defines at least a portion of the sump defined by the cooktop. A bracket is coupled to the first and second frame members. The bracket extends along a portion of a perimeter of the cooktop between the first and second frame members. The bracket defines at least a portion of the sump defined by the cooktop.

17 Claims, 9 Drawing Sheets

(56) References Cited

U.S. PATENT DOCUMENTS

| | | | | |
|---|---|---|---|---|
| 5,399,839 | A * | 3/1995 | Taplan | F24C 15/108 126/211 |
| 5,535,742 | A * | 7/1996 | Neff | F24C 15/36 126/211 |
| 7,049,552 | B2 | 5/2006 | Arntz et al. | |
| 7,640,930 | B2 | 1/2010 | Little et al. | |
| 7,950,383 | B2 * | 5/2011 | Brant | F24C 15/10 126/1 R |
| 8,269,148 | B2 | 9/2012 | Marchand | |
| 9,841,196 | B2 | 12/2017 | Chavan et al. | |
| 10,605,462 | B2 * | 3/2020 | Todd | F24C 3/124 |
| 2013/0104874 | A1 * | 5/2013 | Jung | F24C 15/10 126/211 |
| 2014/0352151 | A1 * | 12/2014 | Bruin-Slot | F24C 15/2071 29/897.3 |
| 2018/0135862 | A1 * | 5/2018 | Todd | F24C 3/124 |
| 2019/0003716 | A1 | 1/2019 | Je et al. | |

FOREIGN PATENT DOCUMENTS

| | | | | |
|---|---|---|---|---|
| ES | 2381485 | A1 * | 5/2012 | F24C 15/10 |
| ES | 2633599 | A1 | 9/2017 | |
| JP | 2004293809 | A | 10/2004 | |
| JP | 2005155984 | A | 6/2005 | |
| JP | 2007010226 | A | 1/2007 | |
| JP | 4349714 | B2 | 10/2009 | |
| JP | 2010113971 | A | 5/2010 | |
| JP | 2012022775 | A | 2/2012 | |
| JP | 2014228162 | A | 12/2014 | |
| KR | 20030041272 | A * | 5/2003 | F24C 15/107 |
| WO | WO-2013026767 | A1 * | 2/2013 | F24C 15/107 |

OTHER PUBLICATIONS

Gonzalez, Machine Translation (Year: 2012).*
Machine Translation of Hwang (Year: 2003).*
Machine Translation of Gonzalez (Year: 2012).*

* cited by examiner

COOKTOP WITH SIDE FRAME MEMBERS

BACKGROUND OF THE DISCLOSURE

The present disclosure generally relates to a cooktop assembly and, more specifically, to a cooktop assembly including first and second side frame members.

SUMMARY OF THE DISCLOSURE

According to one aspect of the present disclosure, a cooking appliance includes a body and a cooktop disposed on the body. A plurality of gas burner assemblies is mounted on the cooktop. A first frame member is coupled to a first side of the cooktop. A second frame member is coupled to a second side of the cooktop. A bracket is coupled to the first and second frame members. The bracket extends along a portion of a perimeter of the cooktop between the first and second frame members. The first frame member, the second frame member, and the bracket collectively define at least a portion of a sump on an upper portion of the cooktop.

According to another aspect of the present disclosure, a cooktop assembly includes a cooktop defining a sump. A gas burner assembly is operably coupled to the cooktop. A first frame member is coupled to a first side of the cooktop. The first frame member defines a first aperture on an inner surface thereof to define at least a portion of at least one airflow path. A second frame member coupled to an opposing second side of the cooktop. The second frame member defines a second aperture on an inner surface thereof to define at least a portion of the at least one airflow path.

According to yet another aspect of the present disclosure, a cooktop assembly includes a cooktop defining a sump. A first frame member is coupled to a first side of the cooktop and defines at least one first aperture. A second frame member is coupled to a second side of the cooktop and defines at least one second aperture. A bracket is disposed adjacent to an edge of the cooktop. The bracket couples together the first and second frame members.

These and other features, advantages, and objects of the present disclosure will be further understood and appreciated by those skilled in the art by reference to the following specification, claims, and appended drawings.

Figure 1:
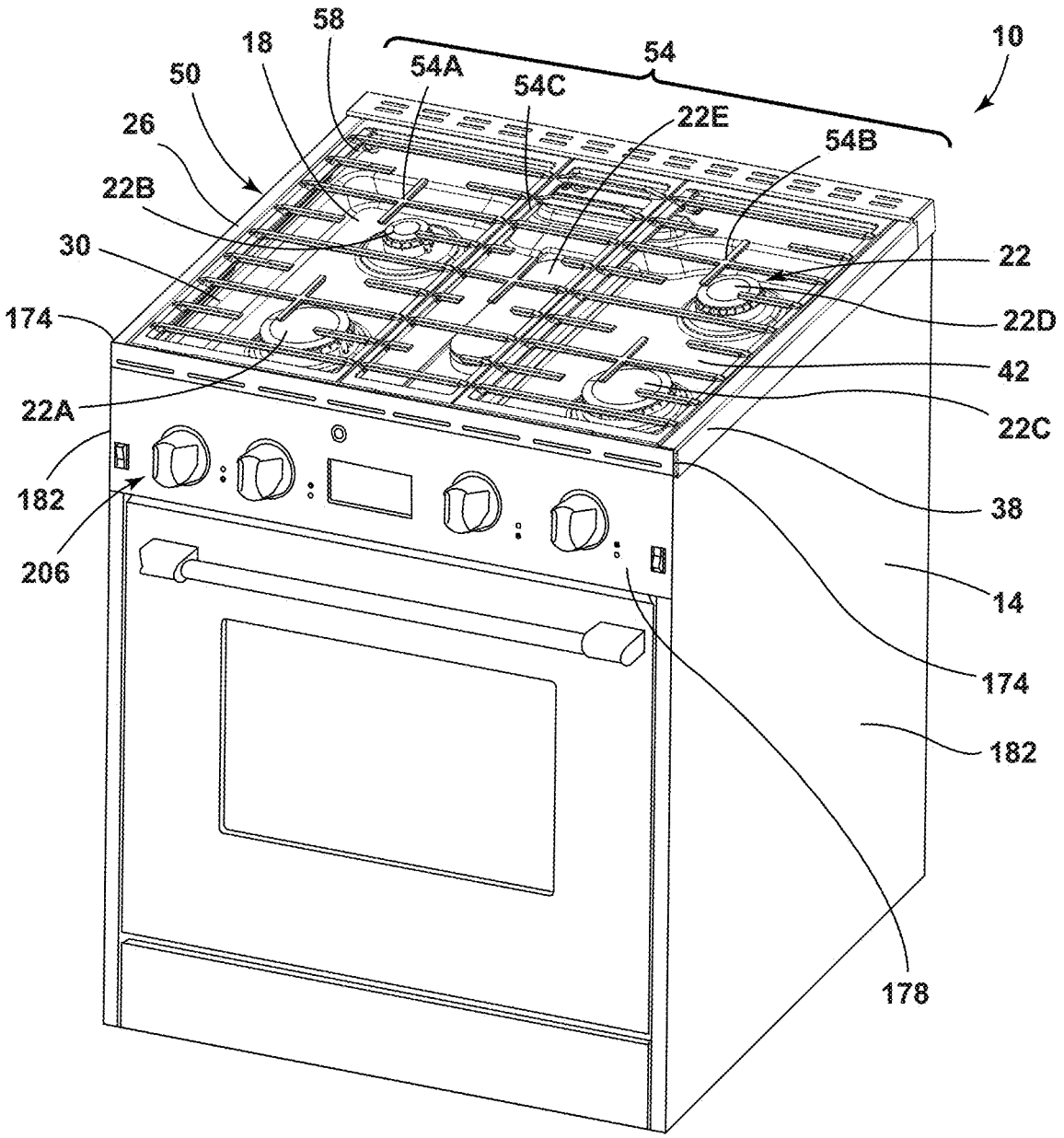
FIG. 1 is a top perspective view of a cooking appliance, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a cooktop with side frame members. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-9, reference numeral 10 generally designates a cooking appliance that includes a body 14 and a cooktop 18 disposed on the body 14. A plurality of gas burner assemblies 22 is mounted on the cooktop 18. A first frame member 26 is coupled to a first side 30 of the cooktop 18. A second frame member 38 is coupled to a second side 42 of the cooktop. A bracket 46 is coupled to the first and second frame members 26,38. The bracket 46 extends along a portion of a perimeter of the cooktop 18 between the first and second frame members 26,38. The first frame member, the second frame member, and the bracket 46 collectively define at least a portion of a sump 34 on an upper portion of the cooktop 18.

Referring to FIG. 1, the cooking appliance 10 is illustrated with the cooktop 18 disposed on the body 14, which is configured as an oven. It is contemplated that the cooktop 18 may be disposed on a single oven, a double oven, and/or a combination thereof. It is further contemplated that the cooktop may be disposed on another appliance and/or on a countertop as a stand-alone cooktop or cooking hob. The cooktop 18 includes the plurality of gas burner assemblies 22, which may include individual gas burner assemblies 22A-22E. Two of the gas burner assemblies 22A,22B may be disposed proximate the first side 30 of the cooktop 18, and to additional gas burner assemblies 22C,22D may be disposed proximate the second side 42 of the cooktop 18. Additionally or alternatively, the additional gas burner assembly 22E may be centrally located on the cooktop 18. The plurality of gas burner assemblies 22 may be individually positioned at any useful and/or practicable location along the cooktop 18 and may vary in size and/or configuration, as needed.

The cooking appliance 10 includes a cooktop assembly 50 with the cooktop 18 and a grate 54 disposed over the cooktop 18. The cooktop 18 may include a single grate 54 or may include more than one grate 54. As illustrated, the cooking appliance 10 includes a first grate 54A disposed over two gas burner assemblies 22A,22B, a second grate 54B disposed over two gas burner assemblies 22C,22D, and a third grate 54 disposed over the centrally located gas burner assembly 22E. It is also contemplated that the grates 54 may have any other useful and/or practical configurations relative to the cooktop 18 and/or the gas burner assemblies 22A-22E. According to various aspects, the grates 54A-54C may be removable and replaceable by a user. Additionally or alternatively, the grates 54A-54C may be rotatable via a hinge assembly so the grates 54A-54C are operable between a lowered use position and a raised position for accessing the cooktop 18. The grates 54A-54C may rest upon, or otherwise couple with, an edge 58 of the cooktop.

Figure 2:
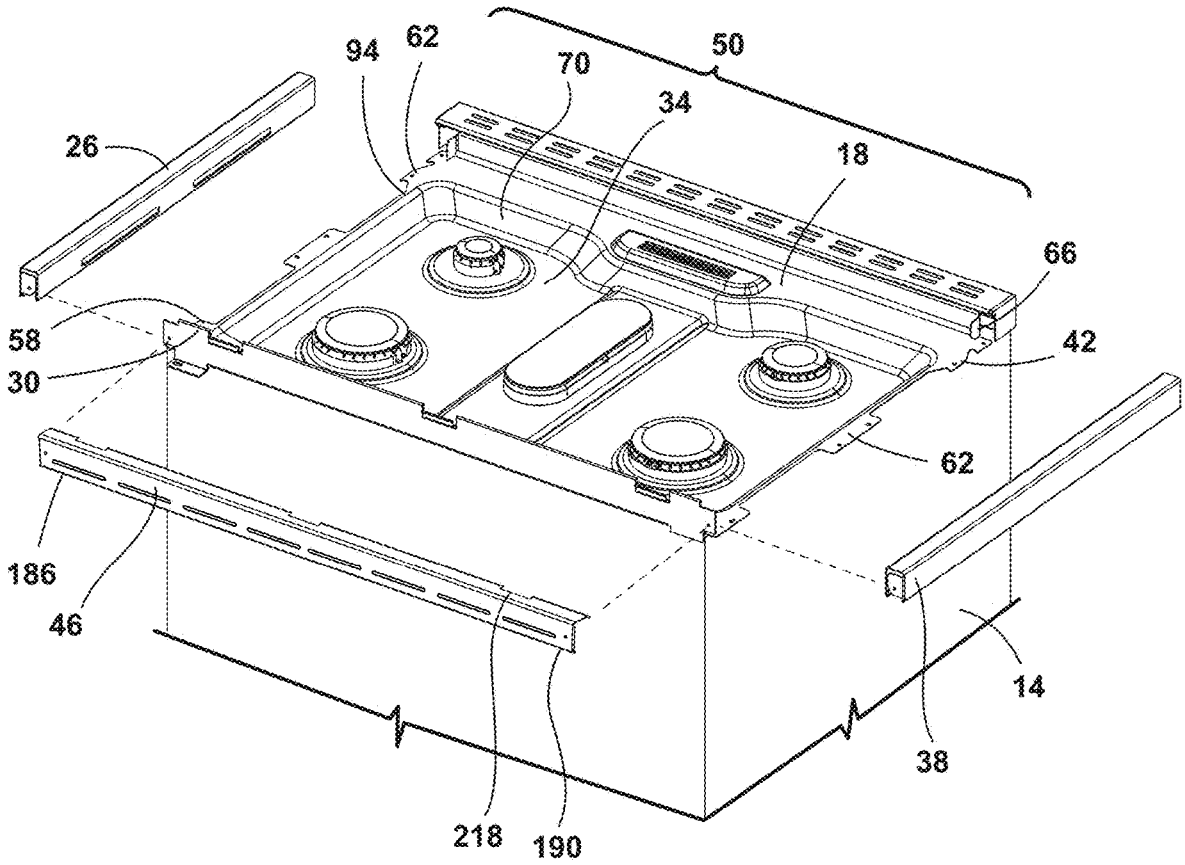
FIG. 2 is an exploded view of a cooktop assembly with first and second side frames, according to the present disclosure.

Referring to FIG. 2, the cooktop 18 may be coupled to the body 14 along the first and second sides 30,42. In various examples, the first and second sides 30,42 of the cooktop 18 may define attachment portions 62 extending outward from the cooktop 18. As illustrated, the attachment portions 62 are configured as flat extensions of the edge 58 of the first and second sides 30,42 of the cooktop 18. The attachment portions 62 define holes 66 for receiving a fastener to mechanically fasten the cooktop 18 to the body 14. The fastener may be, for example, a bolt, screw, pin, or other similar coupling members.

In various examples, the cooktop 18 defines the sump 34. The sump 34 is illustrated being centrally located in the cooktop 18; however, any useful location of the sump 34 is contemplated without departing from the teachings herein. The sump 34 may have a surface that is lower relative to the edge 58 of the cooktop 18. In this way, the cooktop 18 includes sidewalls 70 extending between the edge 58 of the cooktop 18 and an upper surface 74 of the cooktop 18 within the sump 34.

Figure 3:
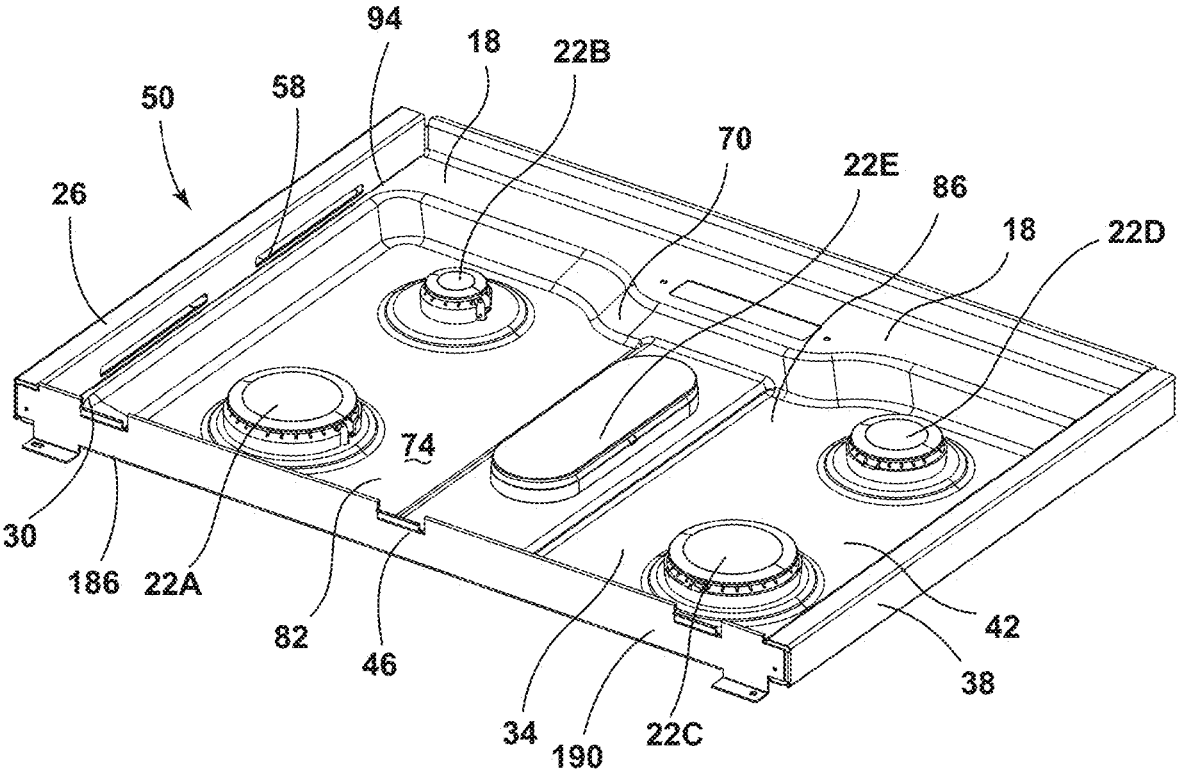
FIG. 3 is a top perspective view of the cooktop assembly of FIG. 2.

Referring to FIGS. 2 and 3, the cooktop 18 may include burner portions 78 that are raised relative to the upper surface 74 within the sump 34. The burner portions 78 may be substantially circular or oblong to correspond with the shape of the gas burner assemblies 22A-22E. The burner portion 78 corresponding with the centrally located gas burner assembly 22E may be substantially rectangular or oblong, extending from the sidewall 70 proximate a front portion 82 of the cooktop 18 to the sidewall 70 proximate a rear portion 86 of the cooktop 18. In this way, the burner portion 78 corresponding to the centrally located gas burner assembly 22E may separate the sump 34 into two side portions. The burner portions 78 of the cooktop 18 may each define an opening 90 in which the gas burner assemblies 22A-22E extend through, respectively. In this way, the gas burner assemblies 22A-22E are mounted on the cooktop 18.

Referring to FIG. 3, the cooktop assembly 50 may include the first and second frame members 26,38. The first frame member 26 may be coupled to the first side 30 of the cooktop 18, and the second frame member 38 may be coupled to the second side 42 of the cooktop 18. As illustrated, the first side 30 corresponds with a left side of the cooktop 18 and the second side 42 corresponds with a right side of the cooktop 18. Other configurations of the first and second frame members 26,38 are contemplated without departing from the teachings herein. The first and second frame members 26,38 may extend along a portion, or alternatively the entirety, of the edges 58 of the first and second sides 30,42 of the cooktop 18, respectively. According to various aspects, the first and second frame members 26,38 may define at least a portion of the sump 34. In this way, the first and second frame members 26,38 may be extensions of the sidewalls 70 defined by the cooktop 18 and may extend the sump 34 above the cooktop 18 accordingly. This configuration may be advantageous for containing liquid and/or food that may spill onto the cooktop 18. Additionally or alternatively, the first and second frame members 26,38 may be contiguous with the sump 34.

According to various aspects, the cooktop assembly 50 includes the bracket 46 extending between the first and second frame members 26,38. Stated differently, the first and second frame members 26,38 may be coupled together via the bracket 46. The bracket 46 may extend along and/or proximate to the edge 58 of the front portion 82 of the cooktop 18. In this way, the bracket 46 extends along at least a portion of the perimeter of the cooktop 18. The bracket 46 may be substantially the same height as the first and second frame members 26,38 relative to the edge 58 of the cooktop 18, which may be advantageous for providing a substantially flat orientation of the grates 54 (FIG. 1) for the user. Additionally or alternatively, similar to the first and second frame members 26,38, the bracket 46 may define at least a portion of the sump 34 and/or enclose the portion of sump 54 defined by the first and second members 26,38 along the front edge 58 of the cooktop 18. The bracket 46 may be a substantially vertical extension of the sidewall 70 proximate the front portion 82 of the cooktop 18. In this way, the first and second frame members 26,38 and the bracket 46 may form substantially vertical surfaces around at least a portion of the perimeter of the cooktop 18, which may be advantageous for containing liquids and foods that spill on the cooktop 18.

Figure 4:
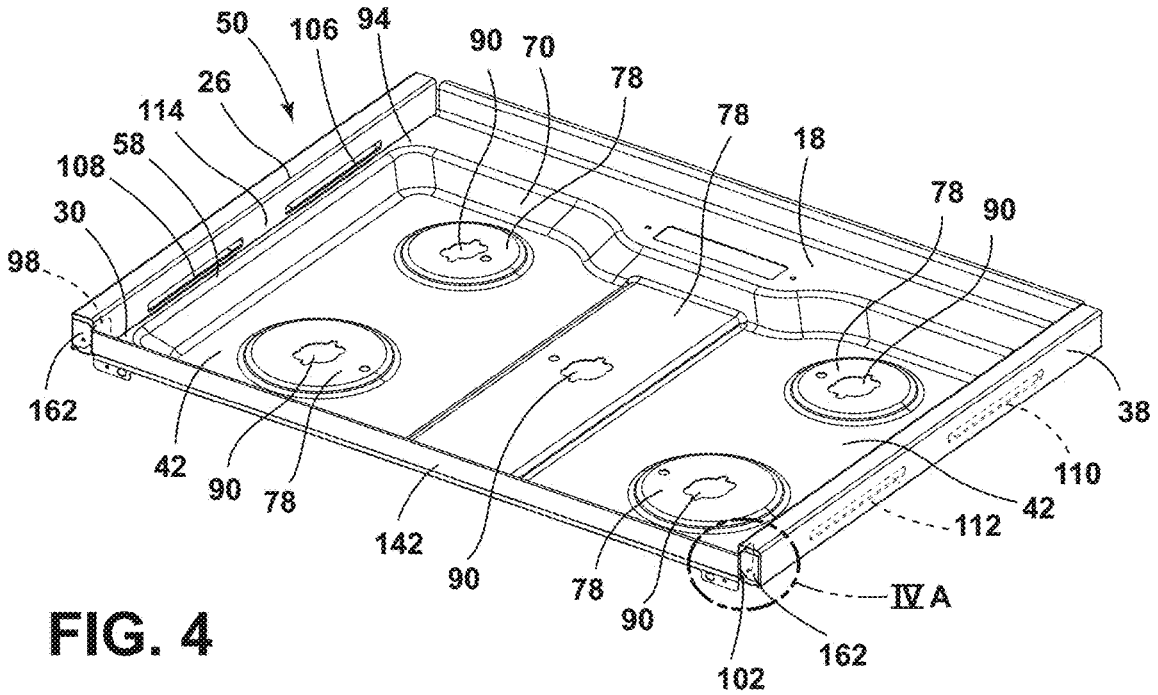
FIG. 4 is a top perspective view of a cooktop assembly, according to the present disclosure.
Figure 4A:
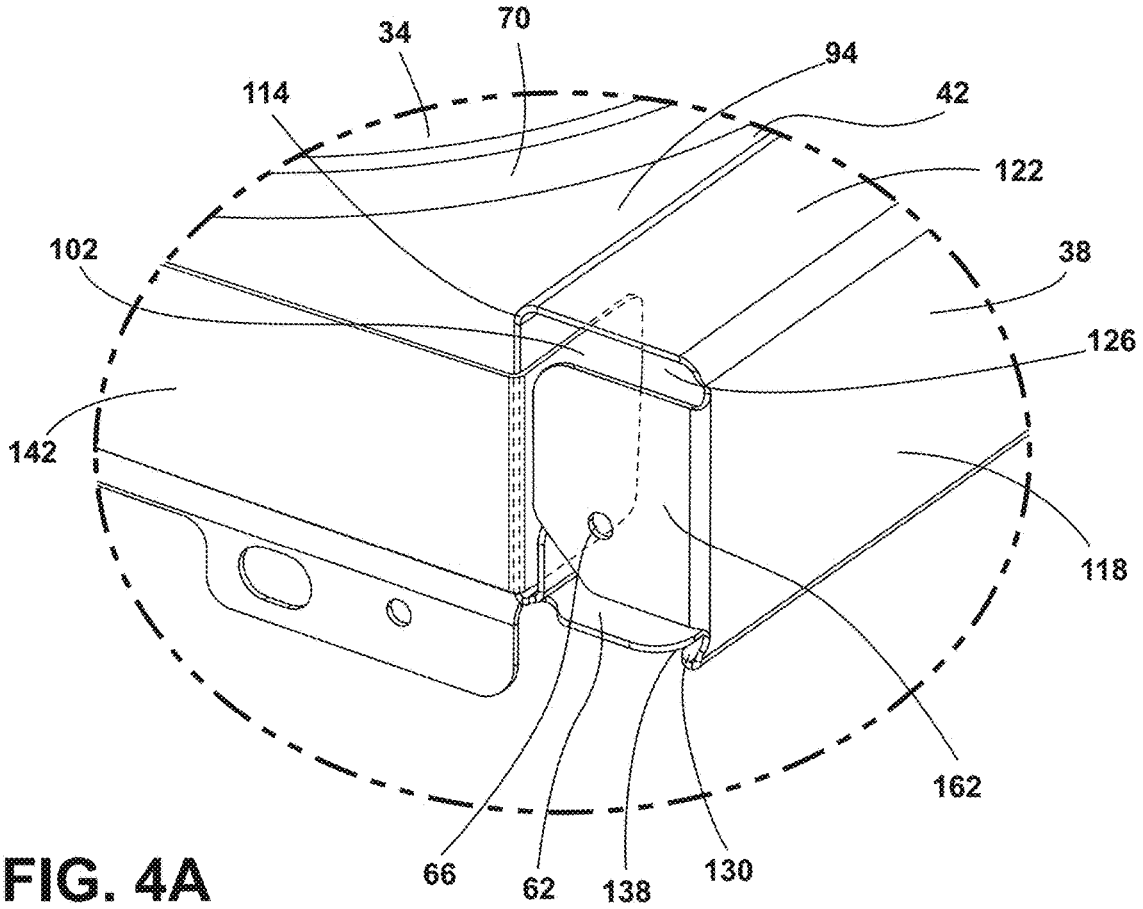
FIG. 4A is an enlarged view of a side frame member engaged with the cooktop taken at area IVA of FIG. 4.

Referring to FIGS. 4 and 4A, the first and second frame members 26,38 may be coupled to the first and second sides 30,42 of the cooktop 18. The first and second frame members 26,38 may be coupled to respective portions of the edge 58 of the cooktop 18. Additionally or alternatively, the cooktop 18 may include a border portion 94 extending at least partially around the perimeter of the cooktop 18. The border portion 94 may be substantially horizontal and/or flat and extend from the edge 58 to the sidewalls 70. In such examples, the first and second frame members 26,38 may be disposed on and/or supported by the border portion 94 of the cooktop 18 proximate the first and second sides 30,42, respectively. In various examples, the cooktop 18 defines first and second flanges 98,102 proximate the first and second sides 30,42, respectively. The first and second flanges 98,102 may support the first and second frame members 26,38, respectively. In various examples, the first frame member 26 defines a first aperture 106 and the second frame member 38 defines a second aperture 110. Additionally or alternatively, the first frame member 26 may define a plurality of first apertures 108 and the second frame member 38 may define a plurality of second apertures 112. Stated differently, the plurality of first apertures 108 may be spaced-apart along the first frame member 26 and the plurality of second apertures 112 may be spaced-apart along the second frame member 38. The first and second apertures 106,110 may substantially be mirror images of one another, or alternatively may define different configurations. Additionally or alternatively, the first and second frame members 26,38 may define the first and second apertures 106,110, respectively, in inner surfaces 114 thereof. In this way, the first and second apertures 106,110 may both be oriented to a central location on the cooktop 18, (e.g., the sump 34). The first and second apertures 106,110 of the pluralities of first and second apertures 108,112 are illustrated having substantially oblong shapes; however, any practicable and/or useful shape is contemplated without departing from the teachings herein. The first frame member 26 may be similarly configured.

As illustrated in FIG. 4A, the second frame member 38 includes the inner surface 114 and an outer surface 118 spaced-apart from and coupled to the inner surface 114 via a top surface 122. In this way, the second frame member 38 may be generally U-shaped. The second frame member 38 may define an inner airflow passage 126 extending along a longitudinal axis thereof. Stated differently, the second frame member 38 may be substantially hollow. According to various aspects, the inner airflow passage 126 is in fluid communication with the second aperture 110. Moreover, a bottom surface 130 of the second frame member 38 may extend between the inner and outer surfaces 114,118. In various examples, the bottom surface 130 may be coupled to the outer surface 118 and extend toward the inner surface 114. In this way, the bottom surface 130 may not be directly coupled to the inner surface 114. The bottom surface 130 and the inner surface 114 may define a gap 138 therebetween. The gap 138 may be in fluid communication with the inner airflow passage 126 and with the second aperture 110 via the inner airflow passage 126.

Figure 5:
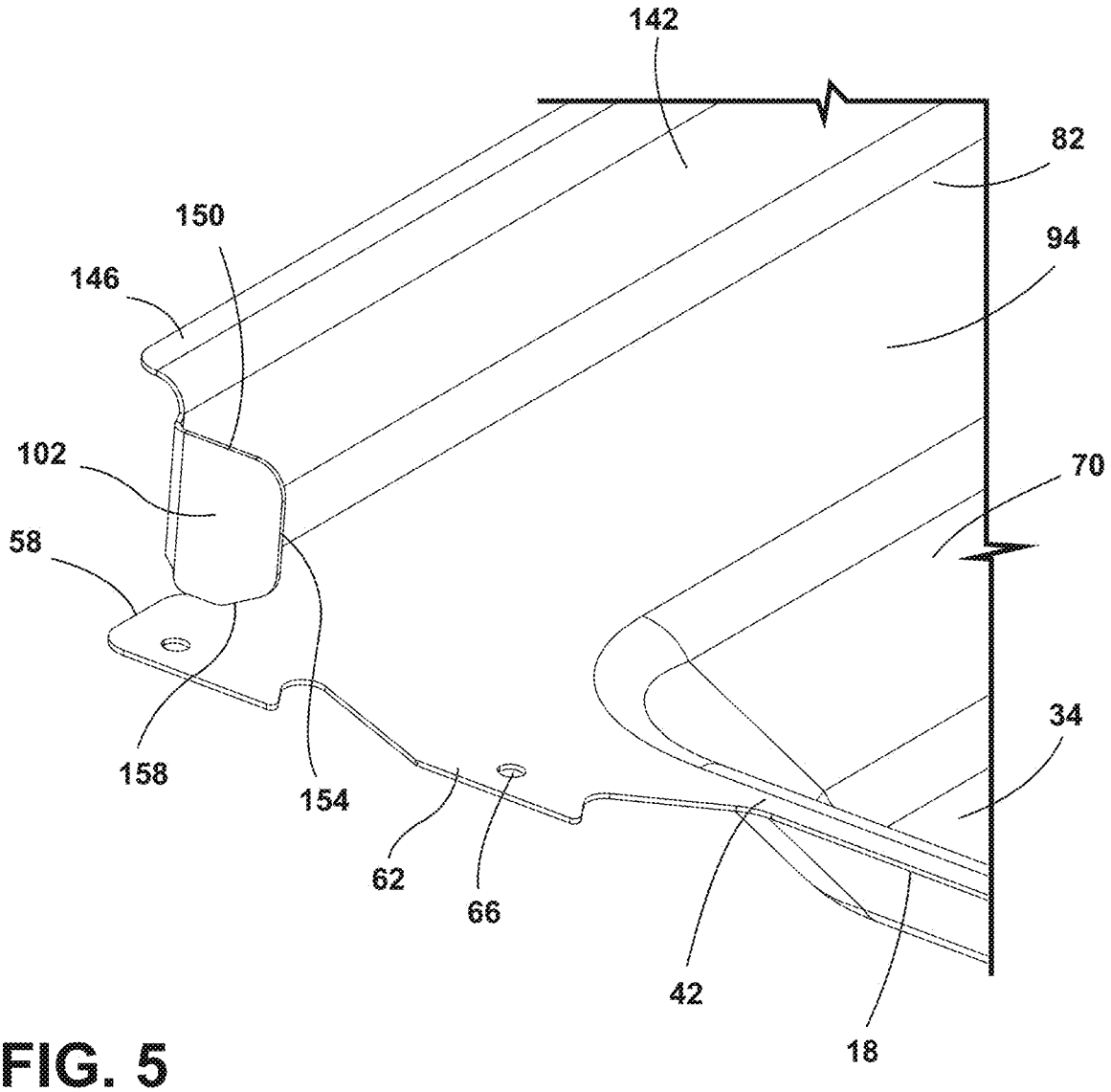
FIG. 5 is a partial side perspective view of a flange of a cooktop, according to the present disclosure.

Referring to FIG. 5, the second flange 102 is illustrated on the second side 42 of the cooktop 18. While described with reference to the second flange 102, it is contemplated that the first flange 98 is arranged in a substantially similar configuration. It is also contemplated that the first and second flanges 98,102 may be mirror images of one another. As illustrated, the border portion 94 of the cooktop 18 may include a rim 142 proximate the front portion 82 of the cooktop 18. The rim 142 may extend substantially vertically from the border portion 94. A top 146 of the rim 142 may also curve away from the cooktop 18. According to various aspects, the rim 142 may define the first and second flanges 98,102. As illustrated in FIG. 5, the second flange 102 extends toward the rear portion 86 (FIG. 3) of the cooktop 18. In this way, the second flange 102 extends substantially perpendicular to the rim 142. The top 146 of the rim 142 may extend higher than the second flange 102, or alternatively, the second flange 102 may be a substantially same height as the rim 142 including the curved top 146. According to various aspects, the bracket 46 may be disposed adjacent to and/or abut the rim 142. Alternatively, the bracket 46 may be spaced apart from the rim 142 by the curved top 146 of the rim 142. Additionally or alternatively, it is also contemplated that the cooktop 18 may not include the rim 142. In such examples, the bracket 46 may be disposed proximate the edge 58 of the front portion 82 of the cooktop 18.

The second flange 102, as illustrated in FIG. 5, extends over the border portion 94 proximate one of the attachment portions 62. A top edge 150 and a rear edge 154 of the second flange 102 may define an approximately 90° angle therebetween. Additionally or alternatively, the second flange 102 may have a chamfered bottom edge 158 for engaging the second frame member 38. In this way, the chamfered bottom edge 158 of the second flange 102 may form a bevel. The bottom edge 158 of the second flange 102 may be spaced-apart from the border portion 94 of the cooktop 18 to provide space for the second frame 38 therebetween. The configuration of the second flange 102 with the chamfered bottom edge 158 may slidably engage the second frame member 38. Further, as described herein within respect to the second flange 102, it is contemplated the first flange 98 may be similarly configured and arranged with respect to the cooktop 18 and the first frame member 26.

Figure 6:
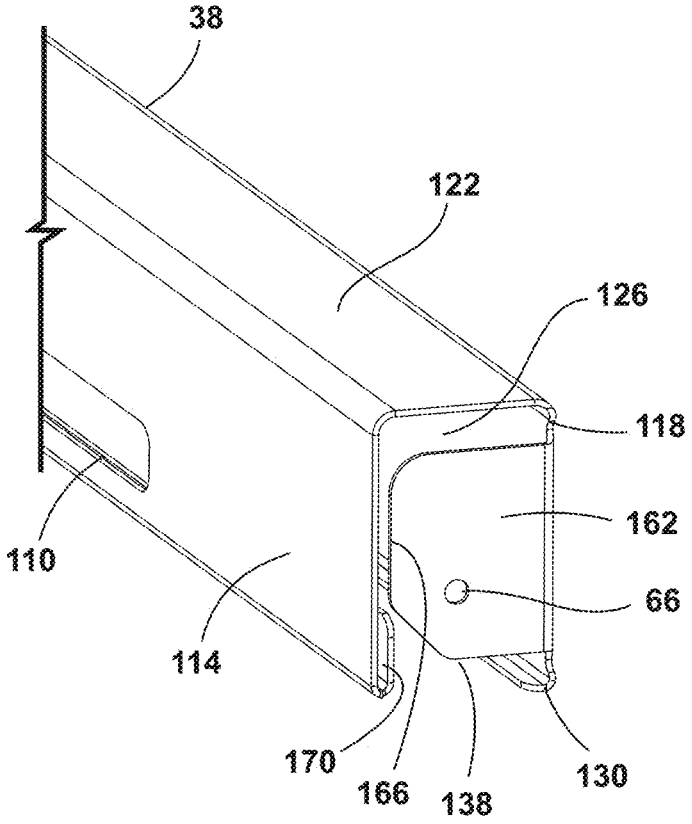
FIG. 6 is a partial front perspective view of a frame member, according to the present disclosure.

Referring to FIG. 6, the second frame member 38 may include a tab 162 extending from the outer surface 118 toward the inner surface 114 to form a front surface. The tab 162 may not directly couple with the inner surface 114, allowing the second frame member 38 to slidably engage and/or accommodate the second flange 102 of the cooktop 18. According to various aspects, the tab 162 may extend a substantial portion of the distance between the inner and outer surfaces 114,118 such that a space defined between an end 166 of the tab 162 and the inner surface 114 substantially corresponds with a thickness of the second flange 102. Additionally or alternatively, the tab 162 may be directly coupled to the top and/or bottom surfaces 122,130 or, alternatively, may be spaced-apart from one or both of the top and bottom surfaces 122,130. However, it is also contemplated that other configurations of the tab 162 relative the second frame member 38 are contemplated without departing from the teachings herein. Additionally or alternatively, the tab 162 defines the hole 66 for receiving a fastener for coupling the second frame member 38 to the bracket 46.

In various examples, the second frame member 38 defines an interior channel 170. The interior channel 170 may be coupled to and/or integrally formed with the inner surface 114 of the second frame member 38. The inner surface 114 may curve inwards toward the outer surface 118 and then upward towards the top surface 122 to form a generally U-shaped interior channel 170 in a lower portion thereof. The interior channel 170 may be any size and/or shape to receive the second flange 102 defined by the cooktop 18. The interior channel 170 may extend along a portion of a height of the inner surface 114 or, alternatively, may extend the entire height and couple to the top surface 122. Additionally or alternatively, the interior channel 170 may extend a portion of the length of the second frame member 38. In this way, the interior channel 170 may not obstruct the inner airflow passage 126 and/or the second aperture 110. The interior channel 170 may extend a length that corresponds with a length of the second flange 102; however, it is contemplated that the interior channel 170 may extend any length along the second frame member 38 that engages the second flange 102 and couples the second frame member 38 to the cooktop 18. While described herein with respect to an enlarged view of the second frame member 38, it is contemplated that the first frame member 26 is substantially a mirror-image of the second frame member 38 and is configured in a similar manner.

Referring again to FIGS. 4-6, the first and second frame members 26,38 may slidably engage the first and second flanges 98,102 of the cooktop 18. The first and second frame members 26,38 may be positioned proximate the first and second flanges 98,102 and shifted, such that the first and second flanges 98,102 slide into the interior channels 170. In this way, the sliding engagement of the first and second frame members 26,38 and the interior channels 170 of the first and second frame members 26,38, respectively, support and couple the first and second frame members 26,38 to the cooktop 18. The engagement between the first and second flanges 98,102 and the first and second frame members 26,38, respectively, may also provide for sharp corners 174 at the front portion 82 of the first and second sides 30,42 of the cooktop 18. As best illustrated in FIG. 1, the sharp corners 174 may substantially align with and/or be arranged flush with corners defined by front and side panels 178,182 of the body 14 of the cooking appliance 10. In this way, the first and second frame members 26,38 may be advantageous for increasing the aesthetics of the cooking appliance 10 and/or the cooktop assembly 50.

Figure 7:
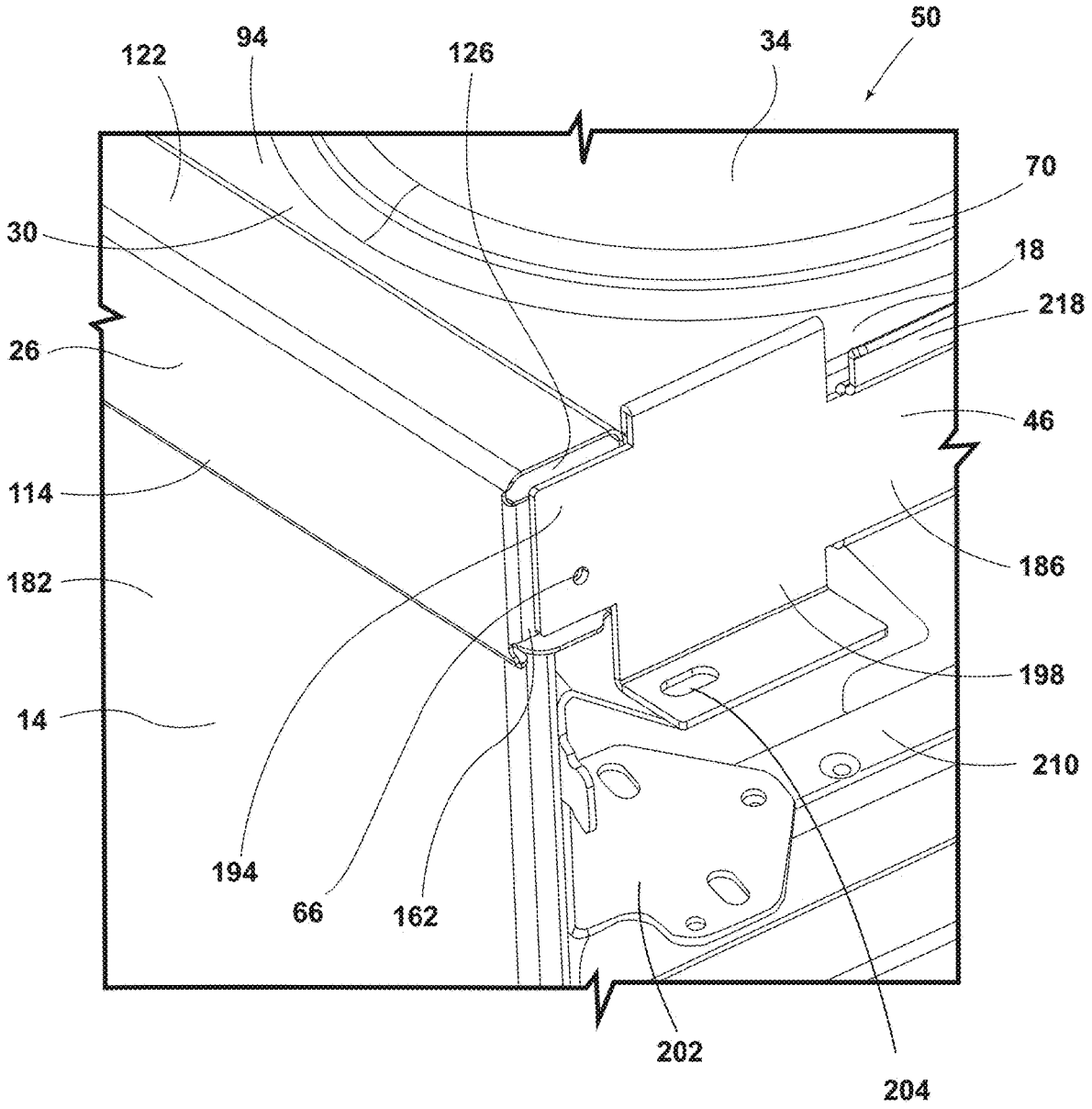
FIG. 7 is a partial side perspective view of a coupling of a frame member, a bracket, and a support member, according to the present disclosure.

Referring to FIGS. 3 and 7, the bracket 46 may be coupled to the first and second frame members 26,38 and extend therebetween. An enlarged view of the engagement between a first end 186 of the bracket 46 and the first frame member 26 is shown in FIG. 7, however, it is contemplated that a second end 190 of the bracket 46 engages with the second frame member 38 in a substantially similar manner. According to various aspects, the first and second ends 186,190 of the bracket 46 each include a lateral extension 194 and a lower extension 198. The lateral extension 194 may be disposed adjacent to the tab 162 of the first frame member 26 when the cooktop assembly 50 is assembled. The lateral extension 194 may have a similar size and/or shape as the tab 162, such that the tab 162 and the lateral extension 194 substantially align with one another. The lateral extension 194 defines the hole 66, which aligns with the hole 66 defined by the tab 162. In this way, a fastener may extend through the holes 66 to mechanically fasten the bracket 46 to the first frame member 26.

According to various aspects, the lower extension 198 may be substantially L-shaped. In this way, the lower extension 198 may extend vertically downward from the bracket 46 and then extend substantially perpendicular to the bracket 46. The lower extension 198 may be disposed adjacent to and/or abut a support member 202 of the body 14 of the appliance 10. The lower extension 198 may define an oblong hole 204 for receiving a fastener. In this way, the bracket 46 may be coupled to the first and second frame members 26,38, as well as the support member 202.

The support member 202 may support the body 14 of the cooking appliance 10 as well as the cooktop assembly 50. The support member 202 may be disposed at least partially within the body 14 of the cooking appliance 10 proximate a user interface 206 (FIG. 1). In this way, the support member 202 may extend between the cooktop 18 and the body 14 defining the oven. The cooking appliance 10 may include two support members 202 configured as mirror-images of one another and disposed adjacent to the first and second sides 30,42, respectively. The support members 202 may be configured as U-shapes, opening inward towards the opposing support member 202. Each support member 202 may be coupled to the bracket 46, the respective side panel 182 of the body 14, and a cross member 210 of the body 14. The support member 202 defines a horizontal surface 214 that is disposed adjacent to and/or abuts the lower extension 198 of the bracket 46. The horizontal surface 214 of the support member 202 may define the oblong hole 204 that is configured to align with the oblong hole 204 of the lower extension 198 for receiving a fastener to couple the bracket 46 to the support member 202. The support member 202 may also be mechanically fastened, or otherwise coupled to, various locations on the body 14 of the cooking appliance 10 (e.g., the side panels 182, the cross member 210, etc.).

Figure 8:
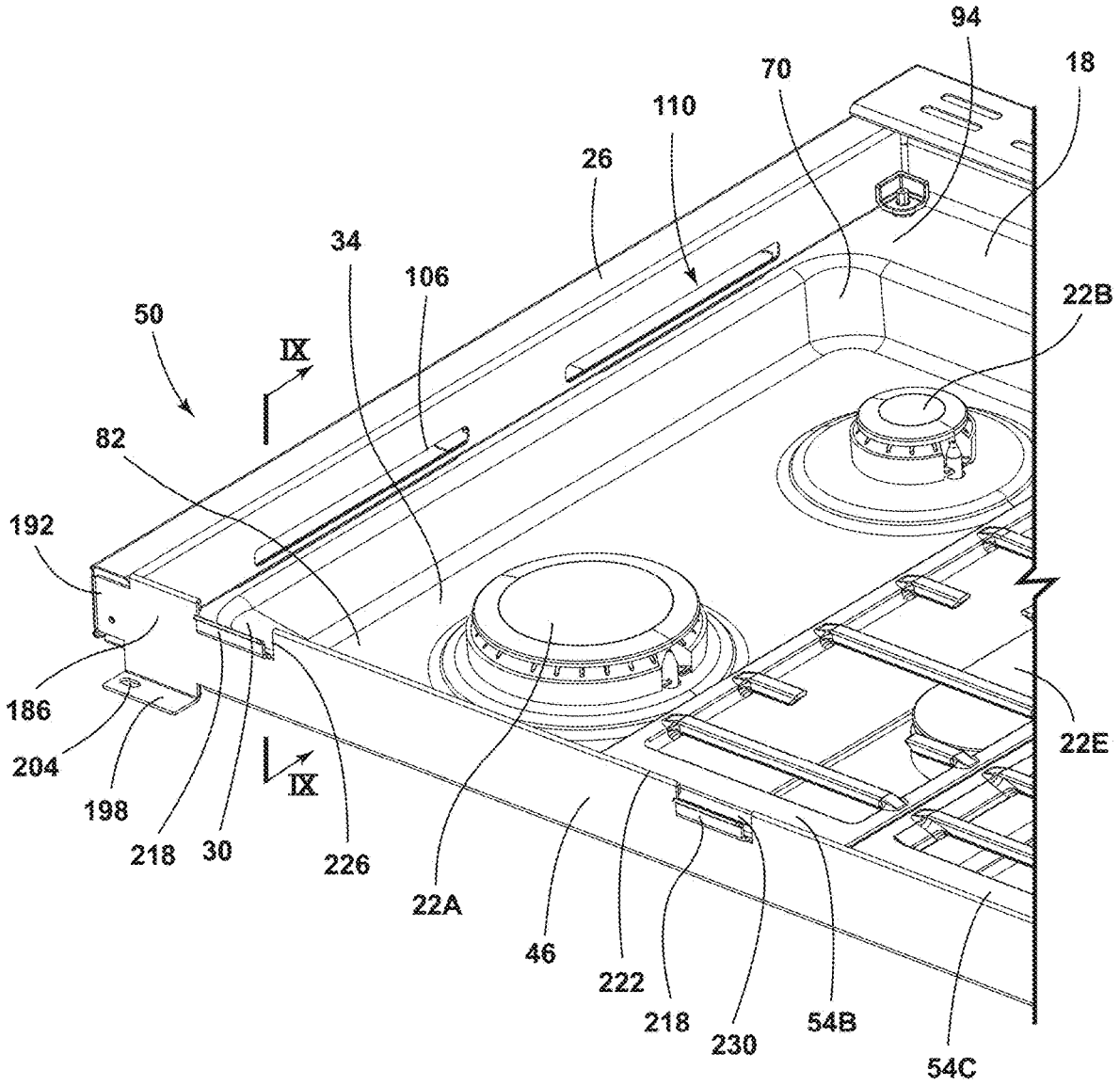
FIG. 8 is a partial top perspective view of a cooktop assembly, according to the present disclosure.

Referring to FIGS. 1 and 8, the bracket 46 may include projections 218 at a top portion 222 thereof. The projections 218 may be substantially L-shaped and/or curved. The bracket 46 may define cutouts 226 that correspond with the shape and/or location of the projections 218. The projections 218 may extend outwards and/or away from the front portion 82 of the cooktop 18. According to various aspects, the grates 54A-54C each include a locating protrusion 230 extending vertically downwards relative to the tops of the grates 54A-54C. The locating protrusion 230 may align with and/or be disposed in the cutouts 226 when the grates 54A-54C are assembled to the cooktop assembly 50. The projections 218 of the bracket 46 may, therefore, be configured to support and/or couple the grates 54A-54C to the cooktop assembly 50. The number of cutouts 226 and/or projections 218 of the bracket 46 may correspond with the number of locating protrusions 230 and/or the number of grates 54A-54C.

Figure 9:
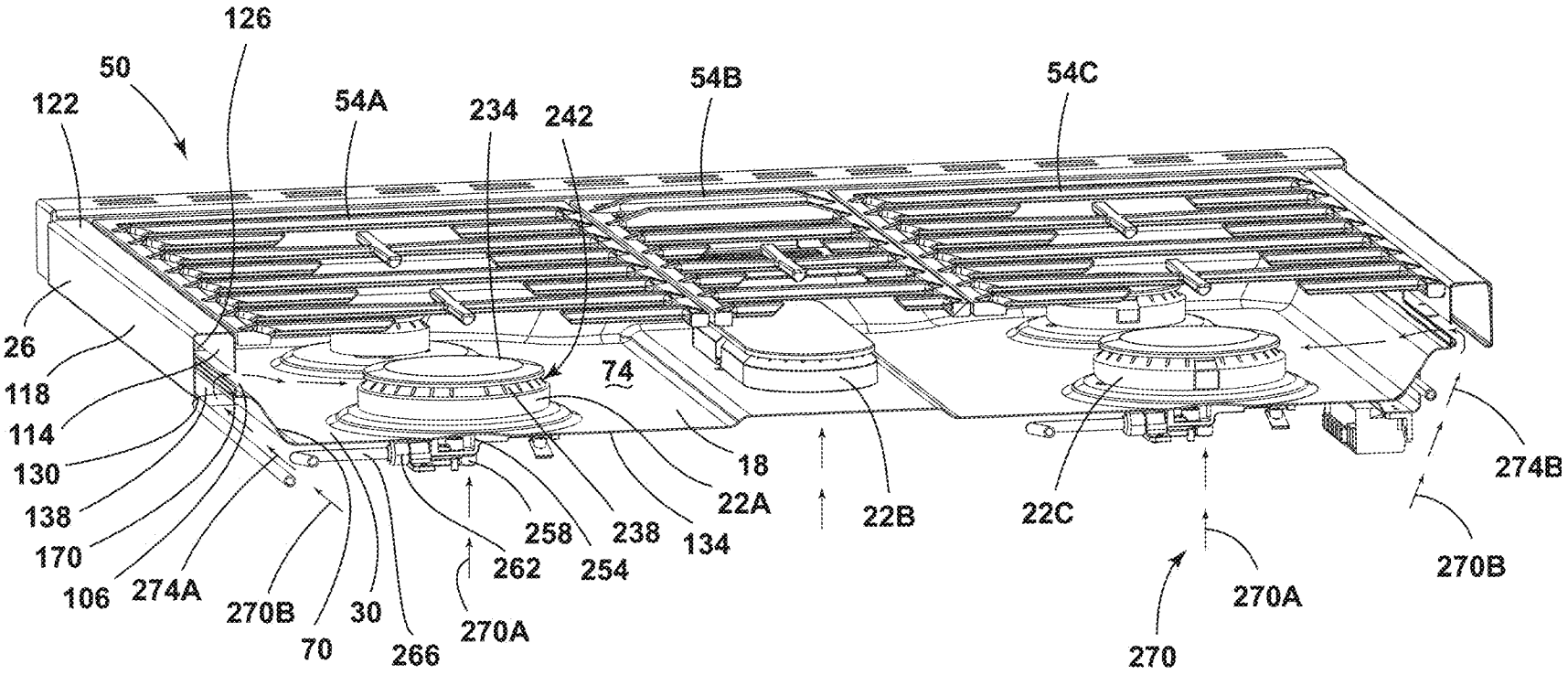
FIG. 9 is a cross-sectional view of the cooktop assembly of FIG. 8 taken along line IX-IX.

Referring to FIG. 9, the grates 54A-54C may be disposed over the cooktop 18 and aligned flush with the top surfaces 122 of the first and second frame members 26,38. This configuration may be advantageous for improving the aesthetics of the cooktop assembly 50. It is also contemplated that one or more of the grates 54A-54C may also be configured as a griddle disposed on the cooktop 18.

In various examples, each of the gas burner assemblies 22A-22E include a burner cap 234 disposed on a spreader 238. A burner crown 242 may be disposed along a perimeter of the spreader 238, where the burner crown 242 defines a series of depressions and spines configured to provide outlets for a fuel/air mixture and further configured for substantially even distribution of flames produced by the gas burner assemblies 22A-22E. It is also contemplated that the perimeter of the spreader 238 may also define a recess for receiving an igniter, which may be, for example, a spark-ignition electrode. The spreader 238 may be disposed on an orifice holder 254. The orifice holder 254 may include a base 258 having a gas injection port 262 for coupling a fuel supply line 266. In this way, a fuel supply may be directed from the fuel supply line 266, through the base 258, and through an inlet defined by the spreader 238.

According to various aspects, the cooktop assembly 50 provides an airflow path 270 to provide air to the fuel supply and/or the flames of the plurality of gas burner assemblies 22. The first and second apertures 106,110 of the first and second frame members 26,38, respectively, may each define at least a portion of the airflow path 270. The airflow path 270 may extend from proximate the lower surface 134 of the cooktop 18 to the sump 34. Stated differently, the airflow path 270 may extend from proximate the lower surface 134 of the cooktop 18 to proximate the upper surface 74 of the cooktop 18.

Referring still to FIG. 9, in various examples, the airflow path 270 may include a primary airflow path 270A and a secondary airflow path 270B. The primary airflow path 270A may provide air to locations proximate the lower surface 134 of the cooktop 18 proximate the orifice holders 254 of the gas burner assemblies 22A-22E. In this way, a mixture of air from the primary airflow path 270A and the fuel supply may be in fluid communication with the gas burner assemblies 22A-22E.

The secondary airflow path 270B may extend from proximate the lower surface 134 to proximate the upper surface 74 of the cooktop 18. According to various aspects, the secondary airflow path 270B provides for air between the upper surface 74 of the cooktop 18 and the grates 54A-54C. In this way, the secondary airflow path 270B may provide air to the flames of the gas burner assemblies 22A-22E proximate the upper surface 74 of the cooktop 18 within the sump 34. The secondary airflow path 270B may be in fluid communication with one or both of the first and second frame members 26,38. In various examples, the secondary airflow path 270B defines a first branch 274A in fluid communication with the first frame member 26 and a second branch 274B in fluid communication with the second frame member 38. Stated differently, the first branch 274A extends from proximate the lower surface 134 of the cooktop 18, through the gap 138 into the inner airflow passage 126 of the first frame member 26, and through the gap 138 into the first aperture 106 to proximate the upper surface 74 of the cooktop 18 within the sump 34. Similarly, the second branch 274B extends from proximate the lower surface 134 of the cooktop 18, through the inner airflow passage 126 of the second frame member 38, and through the second aperture 110 to proximate the upper surface 74 of the cooktop 18 within the sump 34. The combination of the primary and secondary airflow paths 270A,270B may be advantageous for increasing the quality of the flames of the gas burner assemblies 22A-22E.

Use of the structure as presently disclosed may provide for a variety of advantages. For example, the first and second frame members 26,38 defining at least a portion of the sump 34 may provide for an increased sump depth while maintaining the above-described secondary air flow 270B to burner assemblies 22A-22E. Further, the first and second frame members 26,38 may reduce tooling and manufacturing costs compared to a unitary cooking surface defining an inner sump. Additionally, the grates 54A-54C disposed flush with the top surfaces 122 of the first and second frame members 26,38 may increase aesthetics of the cooking appliance 10. Moreover, the primary and secondary airflow paths 270A,270B may increase the amount of air available to the fuel supply and/or the flames, which may increase the quality of the flames. Additional benefits or advantages of using this device may also be realized and/or achieved.

According to at least one aspect, a cooking appliance includes a body and a cooktop disposed on the body. A plurality of gas burner assemblies is mounted on the cooktop. A first frame member is coupled to a first side of the cooktop. A second frame member is coupled to a second side of the cooktop. A bracket is coupled to the first and second frame members. The bracket extends along a portion of a perimeter of the cooktop between the first and second frame members. The first frame member, the second frame member, and the bracket collectively defines at least a portion of a sump on an upper portion of the cooktop.

According to another aspect, a cooktop defines first and second flanges proximate first and second sides. The first and second flanges support the first and second frame members, respectively.

According to still another aspect, first and second frame members each define an interior channel. The interior channels of the first and second frame members are slidably engaged with first and second flanges, respectively.

According to another aspect, first and second flanges include chamfered bottom edges for slidably engaging first and second frame members, respectively.

According to yet another aspect, a support member extends from the body, the body being coupled with and supported by the support member.

According to another aspect, a grate is disposed over the cooktop and aligned flush with top surfaces of first and second frame members.

According to yet another aspect, first and second frame members each define at least one aperture on an inner surface thereof.

According to another aspect, a cooktop assembly includes a cooktop defining a sump. A gas burner assembly is operably coupled to the cooktop. A first frame member is coupled to a first side of the cooktop. The first frame member defines a first aperture on an inner surface thereof to define at least a portion of at least one airflow path. A second frame member coupled to an opposing second side of the cooktop. The second frame member defines a second aperture on an inner surface thereof to define at least a portion of the at least one airflow path.

According to another aspect, at least one airflow path extends from proximate a lower surface of a cooktop to a sump.

According to yet another aspect, at least one airflow path includes a primary airflow path and a secondary airflow path.

According to still another aspect, a secondary airflow path defines a first branch in fluid communication with a first frame member and a second branch in fluid communication with a second frame member.

According to another aspect, a first branch extends from proximate a lower surface of a cooktop and through a first frame member to proximate an upper surface of the cooktop. A second branch extends from proximate the lower surface of the cooktop and through a second frame member to proximate the upper surface of the cooktop.

According to still another aspect, a bracket is coupled between first and second frame members and extends along a portion of a perimeter of a cooktop.

According to another aspect, at least one grate are disposed over a cooktop and aligned flush with top surfaces of first and second frame members.

According to another aspect, first and second frame members each define a gap in a bottom surface thereof. First and second apertures are in fluid communication with the gaps via inner airflow passages defined by the first and second frame member, respectively.

According to still another aspect, a cooktop defines first and second flanges proximate first and second sides. First and second frame members each define an interior channel slidably engaged with the first and second flanges, respectively.

According to another aspect, a cooktop assembly includes a cooktop defining a sump. A first frame member is coupled to a first side of the cooktop and defines at least one first aperture. A second frame member is coupled to a second side of the cooktop and defines at least one second aperture. A bracket is disposed adjacent to an edge of the cooktop. The bracket couples together the first and second frame members.

According to another aspect, a gas burner assembly is operably coupled to the cooktop. A grate is disposed over the cooktop and disposed flush with top surfaces of first and second frame members.

According to still another aspect, first and second frame members each define at least one additional portion of a sump defined by a cooktop.

According to another aspect, at least one first aperture includes a plurality of first apertures spaced-apart along a first frame member. At least one second aperture includes a plurality of second apertures spaced-apart along the second frame member.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooking appliance, comprising:

a body;

a cooktop disposed on the body and defining a sump;

a grate disposed over the cooktop, wherein the sump is in fluid communication with a surrounding environment through the grate;

a plurality of gas burner assemblies mounted on the cooktop and configured to receive air from a primary airflow path that extends from proximate a lower surface of the cooktop to the plurality of gas burners;

a first frame member coupled to a first side of the cooktop;

a second frame member coupled to a second side of the cooktop, the first frame member and the second frame member each defining a portion of a secondary airflow path for directing air from proximate the lower surface of the cooktop to an upper surface of the cooktop;

wherein the cooktop defines first and second flanges proximate the first and second sides, and wherein the first and second flanges support the first and second frame members, respectively;

wherein the first and second flanges include chamfered bottom edges slidably engaged with the first and second frame members, respectively;

a bracket coupled to the first and second frame members, wherein the bracket extends along a portion of a perimeter of the cooktop between the first and second frame members; and wherein the first frame member, the second frame member and the bracket collectively define at least a portion of the sump on an upper portion of the cooktop.

2. The cooking appliance of claim 1, wherein the first and second frame members each define an interior channel, and wherein the interior channels of the first and second frame members are slidably engaged with the first and second flanges, respectively.

3. The cooking appliance of claim 1, further comprising:

a support member extending from the body, the body being coupled with and supported by the support member.

4. The cooking appliance of claim 1, wherein the grate is aligned flush with top surfaces of the first and second frame members.

5. The cooking appliance of claim 1, wherein the first and second frame members each define at least one aperture on an inner surface thereof.

6. A cooktop assembly, comprising:

a cooktop defining a sump;

a grate disposed over the cooktop, the sump being in fluid communication with a surrounding environment through the grate;

a gas burner assembly operably coupled to the cooktop, the gas burner assembly having an orifice holder disposed adjacent to a lower surface of the cooktop;

a first frame member coupled to a first side of the cooktop, wherein the first frame member defines a first aperture on an inner surface thereof to define at least a portion of at least one airflow path;

a second frame member coupled to an opposing second side of the cooktop, wherein the second frame member defines a second aperture on an inner surface thereof to define at least a portion of the at least one airflow path, the at least one airflow path including a primary airflow path configured to direct air from proximate the lower surface to the orifice holder and a secondary airflow path configured to direct air from proximate the lower surface of the cooktop to an upper surface of the cooktop; and wherein the cooktop defines first and second flanges proximate the first and second sides, and wherein the first and second flanges support the first and second frame members, respectively;

wherein the first and second flanges include chamfered bottom edges slidably engaged with the first and second frame members, respectively.

7. The cooktop assembly of claim 6, the secondary airflow path extends from proximate the lower surface of the cooktop, through at least one of the first and second frame members, and to the upper surface of the cooktop within the sump.

8. The cooktop assembly of claim 6, wherein the secondary airflow path defines a first branch in fluid communication with the first frame member and a second branch in fluid communication with the second frame member.

9. The cooktop assembly of claim 8, wherein the first branch extends from proximate the lower surface of the cooktop and through the first frame member to proximate the upper surface of the cooktop, and wherein the second branch extends from proximate the lower surface of the cooktop and through the second frame member to proximate the upper surface of the cooktop.

10. The cooktop assembly of claim 6, further comprising:

a bracket coupled between the first and second frame members and extending along a portion of a perimeter of the cooktop.

11. The cooktop assembly of claim 6, wherein the grate is aligned flush with top surfaces of the first and second frame members.

12. The cooktop assembly of claim 6, wherein the first and second frame members each define a gap in a bottom surface thereof, and wherein the first and second apertures are in fluid communication with the gaps via inner airflow passages defined by the first and second frame member, respectively.

13. The cooktop assembly of claim 6, wherein the first and second frame members each define an interior channel slidably engaged with the first and second flanges, respectively.

14. A cooktop assembly, comprising:

a cooktop having sidewalls at least partially defining a sump;

a grate disposed over the cooktop, wherein the sump is in fluid communication with a surrounding environment through the grate;

a first frame member coupled to a first side of the cooktop and defining at least one first aperture, the first frame defining at least a portion of a first branch of a secondary airflow path for directing air to an upper surface of the cooktop;

a second frame member coupled to a second side of the cooktop and defining at least one second aperture, the second frame defining at least a portion of a second branch of a secondary airflow path for directing air to the upper surface of the cooktop, the secondary airflow path extending from proximate a lower surface of the cooktop, along the sidewalls, through the first and second frame members, and to the upper surface of the cooktop below the grate;

wherein the cooktop defines first and second flanges proximate the first and second sides, and wherein the first and second flanges support the first and second frame members, respectively;

wherein the first and second flanges include chamfered bottom edges slidably engaged with the first and second frame members, respectively; and a bracket disposed adjacent to an edge of the cooktop, wherein the bracket couples together the first and second frame members.

15. The cooktop assembly of claim 14, further comprising:

a gas burner assembly operably coupled to the cooktop and configured to receive air from proximate the lower surface of the cooktop and proximate to the upper surface of the cooktop within the sump, wherein the grate is disposed flush with top surfaces of the first and second frame members.

16. The cooktop assembly of claim 14, wherein the first and second frame members each define at least one additional portion of the sump defined by the cooktop.

17. The cooktop assembly of claim 14, wherein the at least one first aperture includes a plurality of first apertures spaced-apart along the first frame member, and wherein the at least one second aperture includes a plurality of second apertures spaced-apart along the second frame member.

* * * * *